US005832437A

United States Patent [19]

Nishiguchi et al.

[11] Patent Number: 5,832,437

[45] Date of Patent: Nov. 3, 1998

[54] CONTINUOUS AND DISCONTINUOUS SINE WAVE SYNTHESIS OF SPEECH SIGNALS FROM HARMONIC DATA OF DIFFERENT PITCH PERIODS

[75] Inventors: Masayuki Nishiguchi; Jun Matsumoto, both of Kanagawa, Japan

[73] Assignee: Sony Corporation, Tokyo, Japan

[21] Appl. No.: 515,913

[22] Filed: Aug. 16, 1995

[30] Foreign Application Priority Data

Aug. 23, 1994 [JP] Japan ..... 6-198451

[51] Int. Cl.[6] ..... G10L 7/02; G10L 9/18

[52] U.S. Cl. ..... 704/268; 704/269

[58] Field of Search ..... 395/2.77, 2.78; 704/268, 269

[56] References Cited

U.S. PATENT DOCUMENTS

| | | | |
|---|---|---|---|
| 4,797,926 | 1/1989 | Bronson et al. | 704/265 |
| 4,937,873 | 6/1990 | McAulay et al. | 704/265 |
| 5,086,475 | 2/1992 | Kutaragi et al. | 704/214 |
| 5,327,518 | 7/1994 | George et al. | 704/211 |
| 5,504,833 | 4/1996 | George et al. | 704/211 |
| 5,517,595 | 5/1996 | Kleijn | 704/205 |

FOREIGN PATENT DOCUMENTS

| | | |
|---|---|---|
| 0590155 | 4/1994 | European Pat. Off. . |
| 9210830 | 6/1992 | WIPO . |

OTHER PUBLICATIONS

Quatieri & McAulay, Speech Transformations Based on a Sinusoidal Representation, IEEE Transactions on Acoustics, Speech, and Signal Processing, vol. ASSP—34, No. 6 (Dec. 1986).

Meuse, A 2400 bps Multi—Band Excitation Vocoder, International Conference on Acoustics, Speech, and Signal Processing, vol. 1 (Albuquerque, New Mexico) (Apr. 3–6, 1990).

McAulay & Quatieri, Computationally Efficient Sine—Wave Synthesis and its Application to Sinusoidal Transform Coding, International Conference on Acoustics, Speech, and Signal Processing, vol. 1 (New York) (Apr. 11–14, 1988).

*Primary Examiner*—David R. Hudspeth
*Assistant Examiner*—Talivaldis Ivar Smits
*Attorney, Agent, or Firm*—Jay H. Maioli

[57] ABSTRACT

A method for decoding encoded speech signals uses sine wave synthesis based on harmonics of the original speech signal. The harmonics are obtained by transforming the original speech signal from a time domain to a frequency domain, and the harmonics are arranged as sequential frames with the harmonics of a given frame having a pitch period that may or may not be the same as the pitch period of another frame. According to the decoding method, data arrays respectively containing amplitude data and phase data of the harmonics are zero-padded to provide the arrays with a pre-set number of elements. Inverse orthogonal tarnsformation of the data arrays produces time domain information used to generate a time domain waveform signal for restoring the encoded speech signals. The different pitch periods of the frames are normalized to each other either by smooth (continuous) or acute (discontinuous) interpolation depending on the degree of change in the pitch period between the frames.

9 Claims, 7 Drawing Sheets

FIG.3A1 FIG.3A2 FIG.3B1 FIG.3B2 FIG.3C1 FIG.3C2 FIG.3D

CONTINUOUS AND DISCONTINUOUS SINE WAVE SYNTHESIS OF SPEECH SIGNALS FROM HARMONIC DATA OF DIFFERENT PITCH PERIODS

BACKGROUND

1. Field of the Invention

This invention relates to a method for decoding encoded speech signals. More particularly, it relates to a decoding method in which it is possible to diminish the amount of arithmetic-logical operations required when decoding the encoded speech signals.

2. Background of the Invention

There are known various encoding methods for effecting signal compression by taking advantage of statistical characteristics of audio signals, including speech and audio signals, in the time domain and the frequency domain, and psychoacoustic characteristics of the human auditory system. These encoding methods may roughly be classified into encoding in the time domain, encoding in the frequency domain and analysis/synthesis encoding.

High-efficiency encoding of speech signals may be achieved by multi-band excitation (MBE) coding, single-band excitation (SBE) coding, linear predictive coding (LPC), and coding by discrete cosine transform (DCT), modified DCT (MDCT) or fast Fourier transform (FFT).

In the MBE coding and harmonic coding methods, among these speech coding methods, in which sine wave synthesis is utilized on the decoder side, amplitude interpolation and phase interpolation are carried out based upon data encoded at and transmitted from the encoder side, such as amplitude data and phase data of harmonics. Time domain waveforms for the harmonics, the frequency and amplitude of which change with lapse of time, are calculated, and the time domain waveforms respectively associated with the harmonics are summed to derive a synthesized waveform.

Consequently, a number on the order of tens of thousands of sum-of-product operations (multiplying and summing operations) are required for each block as a coding unit using an expensive high-speed processing circuit. This proves to be a hindrance in applying the encoding method to, for example, a hand-portable telephone.

SUMMARY OF THE INVENTION

It is therefore a principal object of the present invention to provide a method for decoding encoded speech signals.

The present invention provides a method for decoding encoded speech signals in which the encoded speech signals are decoded by sine wave synthesis based upon the information of respective harmonics spaced apart from one another by a pitch period or interval. These harmonics are obtained by transforming speech signals into corresponding information in the frequency domain, that is, on the frequency axis. The decoding method includes the steps of appending zero data to a data array representing the amplitude of the harmonics to produce a first array having a pre-set number of elements, appending zero data to a data array representing the phase of the harmonics to produce a second array having a pre-set number of elements, performing inverse orthogonal transformation of the first and second arrays into information in the time domain, that is, on the time axis, and restoring an original time domain waveform signal with an original pitch period based upon a time domain waveform produced by inverse orthogonal transformation.

According to the present invention, the respective harmonics of neighboring frames are arrayed at a pre-set spacing or pitch period on the frequency axis and the remaining portions of the frames are stuffed with zeros. The resulting arrays undergo inverse orthogonal transformation to produce time domain waveforms of the respective frames which are interpolated and synthesized. This allows a reduction in volume of arithmetic operations required for decoding the encoded speech signals.

In the method for decoding encoded speech signals, encoded speech signals are decoded by sine wave synthesis based upon the information of respective harmonics spaced apart from one another by a pitch period interval, in which the harmonics are obtained by transforming speech signals into corresponding information in the frequency domain, that is, on the frequency axis. Zero data are appended to a data array representing the amplitude of the harmonics to produce a first array having a pre-set number of elements, and zero data are similarly appended to a data array representing the phase of the harmonics to produce a second array having a pre-set number of elements. These first and second arrays undergo inverse orthogonal transformation into the information in the time domain, that is, on the time axis, and an original time domain waveform signal with an original pitch period is restored based upon the time domain waveform signal produced by inverse orthogonal transformation. This enables synthesis of a playback waveform based upon the information of the harmonics in terms of frames having different pitch periods using a smaller volume of arithmetic-logical operations.

Since the spectral envelopes between neighboring frames are interpolated smoothly (continuously) or steeply (discontinuously) depending upon the degree of pitch period change between the neighboring frames, it becomes possible to produce synthesized output waveforms suited to frames of varying states.

It should be noted that in conventional sine wave synthesis, amplitude interpolation and phase or frequency interpolation are carried out for each of the harmonics. Time domain waveforms of the respective harmonics, the frequency and the amplitude of which change with lapse of time, are calculated based upon the interpolated harmonics, and the time domain waveforms associated with the respective harmonics are summed to produce a synthesized waveform. Thus the volume of the sum-of-product operations reaches a number on the order of several thousand steps. With the method of the present invention, the volume of arithmetic operations may be diminished to several thousand steps. Such a reduction in the volume of processing operations has outstanding practical advantages because synthesis represents the most critical portion of the overall processing operations. By way of an example, if the present decoding method is applied to a decoder of the multi-band excitation (MBE) encoding system, the processing capability of the decoder may be decreased to several MIPS as compared to a score of MIPS required with the conventional method.

DESCRIPTION OF THE PREFERRED EMBODIMENT

Before proceeding to the description of the decoding method for encoded speech signals embodying the present invention, an example of the conventional decoding method employing sine wave synthesis is explained.

Data sent from an encoding apparatus (encoder) to a decoding apparatus (decoder) includes at least pitch period data specifying the distance between harmonics and amplitude data corresponding to the spectral envelope.

Among the known speech encoding methods using sine wave synthesis on the decoder side, there are the above-mentioned multi-band excitation (MBE) encoding method and the harmonic encoding method. The MBE encoding system is now explained briefly.

With the MBE encoding system, speech signals are grouped into blocks for every pre-set number of samples, for example, every 256 samples, and converted into spectral components on the frequency axis by orthogonal transformation, such as FFT. Simultaneously, the pitch period information of the speech in each block is extracted and the spectral components on the frequency axis are divided into bands at a spacing corresponding to the pitch period in order to effect discrimination of the voiced sound (V) and unvoiced sound (UV) from one band to another. The V/UV discrimination information, pitch period information and amplitude data of the spectral components are encoded and transmitted.

If the sampling frequency on the encoder side is 8 kHz, the entire bandwidth is 3.4 kHz, with the effective frequency band being 200 to 3400 Hz. The pitch lag from the high side of the female speech to the low side of the male speech, expressed in terms of the number of samples for the pitch period, is on the order of 20 to 147. Thus the pitch period fluctuates from 8000/147≈54.4 Hz to 8000/20=400 Hz. In other words, there are present about 8 to 63 pitch pulses or harmonics in a range up to 3.4 kHz on the frequency axis.

Although the phase information of the harmonic components may be transmitted, this is not necessary because the phase can be determined on the decoder side by techniques such as the so-called least phase transition method or zero phase method.

Figure 1:
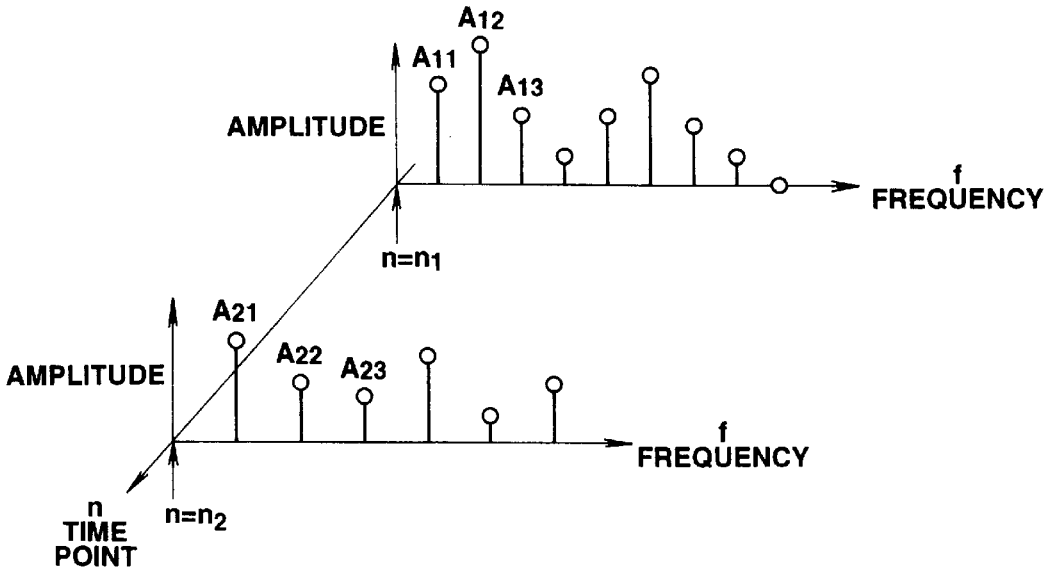
FIG.1 (PRIOR ART)
FIG. 1 illustrates amplitudes of harmonics on frequency axes at different time points.

FIG. 1 shows an example of data supplied to the decoder carrying out the sine wave synthesis.

That is, FIG. 1 shows a spectral envelope on the frequency axis at time points $n=n_1$ and $n=n_2$. The time interval between the time points $n_1$ and $n_2$ in FIG. 1 corresponds to a frame interval as a transmission unit for the encoded information. Amplitude data on the frequency axis, as the encoded information obtained from frame to frame, are indicated as $A_{11}, A_{12}, A_{13}, \ldots$ for time point $n_1$ and as $A_{21}, A_{22}, A_{23}, \ldots$ for time point $n_2$. The pitch period or frequency at time point $n=n_1$ is $\omega_1$, while the pitch period or frequency at time point $n=n_2$ is $\omega_2$.

It is the purpose of the main processing procedure at the time of decoding by the usual sine wave synthesis to interpolate two groups of spectral components different in amplitude, spectral envelope, pitch period or distances between harmonics, and to reproduce a time domain waveform from time point $n_1$ to time point $n_2$.

Specifically, in order to produce a time domain waveform from an arbitrary m'th harmonic, amplitude interpolation is carried out as an initial procedure. If the number of samples in each frame interval is L, an amplitude $A_m(n)$ of the m'th harmonic or the m'th order harmonics at time point n is given by $$A_m(n) = \frac{n_2 - n}{L} A_{1m} + \frac{n - n_1}{L} A_{2m} n_1 \leqq n_2 < n_2 \tag{1}$$

If, for calculating the phase $\theta_m(n)$ of the m'th harmonic at the time point n, the time point n is set so as to be at the $n_0$'th sample counted from the time point $n_1$, that is $n-n_1=n_0$, the following equation (2) holds:

$$\theta_m(n) = m \cdot \omega_1 \cdot n_0 + \frac{n_0^2}{2L} m(\omega_2 - \omega_1) + \phi_{1m} \tag{2}$$

In equation (2), $\Phi_{1m}$ is the initial phase of the m'th harmonics for $n=n_1$, whereas $\omega_1$ and $\omega_2$ are basic angular frequencies or the pitch periods at $n=n_1$ and $n=n_2$, respectively and correspond to $2\pi$/pitch lag. m and L denote the number or order of the harmonics and the number of samples in each frame interval, respectively.

Equation (2) is derived from $$\begin{aligned}
\theta_m(n) &= \phi_{1m} + \int_{n_1}^{n} \omega_m(k)dk \\
&= \phi_{1m} + \int_{n_1}^{n} \left\{ \frac{n_2 - k}{L} \omega_1 m + \frac{k - n_1}{L} \omega_2 m \right\} dk \\
&= \phi_{1m} + \\
&\quad \int_{0}^{n-n_1} \left\{ \frac{n_2 - (k + n_1)}{L} \omega_1 m + \frac{(k + n_1) - n_1}{L} \omega_2 m \right\} dk \\
&= \phi_{1m} + \int_{0}^{n-n_1} \left\{ \left( 1 - \frac{k}{L} \omega_1 m + \frac{k}{L} \omega_2 m \right\} dk \right. \\
&= \phi_{1m} + \left[ \left( k - \frac{k^2}{2L} \right) \omega_1 m + \frac{k^2}{2L} \omega_2 m \right]_0^{n-n_1} \\
&= \phi_{1m} + m\omega_1(n - n_1) + \frac{(n - n_1)^2}{2L} (\omega_2 - \omega_1)m
\end{aligned}$$

with the frequency $\omega_m(k)$ of the m'th harmonic being $$\omega_m(k)=(n_2-k)\omega_1 m/L+(k-n_1)\omega_2 m/L, \text{ where } n_1 \leqq k < n_2$$

By using equations (1) and (2), equation (3)

$$W_m(n)=A_m(n)\cos(\theta_m(n)) \quad (3)$$

is set, and equation (3) represents the time domain waveform $W_m(n)$ for the m'th harmonic. If we take the sum of the time waveforms domain for all of the harmonics, we obtain the ultimate synthesized waveform V(n).

$$V(n)=\sum_m W_m(n)=\sum_m A_m(n)\cos(\theta_m(n)),\ n_1 \leqq n < n_2 \quad (4)$$

The above description is for the conventional decoding method by routine sine wave synthesis.

If, with the above method, the number of samples for each frame interval L is e.g., 160, and the maximum number m of harmonics is 64, about five sum-of-product operations are required for the calculations of the equations (1) and (2), so that approximately 160×64×5=51200 sum-of-product operations are required for each frame. The present invention envisages to diminish the enormous volume of sum-of-product operations.

The method for decoding the encoded speech signals according to the present invention is now explained.

What should be considered in preparing a time domain waveform from the spectral information data obtained by inverse fast Fourier transform (IFFT) techniques is that, if a series of amplitudes $A_{11}, A_{12}, A_{13}, \ldots$ for $n=n_1$ and a series of amplitudes $A_{21}, A_{22}, A_{23}, \ldots$ for $n=n_2$ are simply deemed to be spectral data and reverted by IFFT to time domain waveform data which is processed by overlap-and-add (OLA) technique, there is no possibility of changing the pitch period or frequency from $m\omega_1$ to $m\omega_2$. For example, if the waveform of 100 Hz and a waveform of 110 Hz are overlapped and added, a waveform of 105 Hz cannot be produced. On the other hand, $A_m(n)$ in equation (1) cannot be derived by interpolation by OLA techniques because of the difference in frequency.

Consequently, the series of amplitudes are correctly interpolated and subsequently the pitch period is changed smoothly or continuously from $m\omega_1$ to $m\omega_2$. However, it makes no sense to find the amplitude $A_m$ by interpolation from one harmonic to another as done conventionally because the desired effect of diminishing the volume of arithmetic operations cannot be achieved. Thus it is desirable to calculate the amplitude $A_m$ at a time n by IFFT and OLA.

On the other hand, a signal of the same frequency component can be interpolated before IFFT or after IFFT with the same results. That is, if the frequency remains the same, the amplitude can be completely interpolated by IFFT and OLA.

With this in consideration, the m'th harmonics at time $n=n_1$ and $n=n_2$ in the present embodiment are configured to have the same frequency. Specifically, the spectral components of FIG. 1 are converted into those shown in FIG. 2 or deemed to be as shown in FIG. 2.

Figure 2:
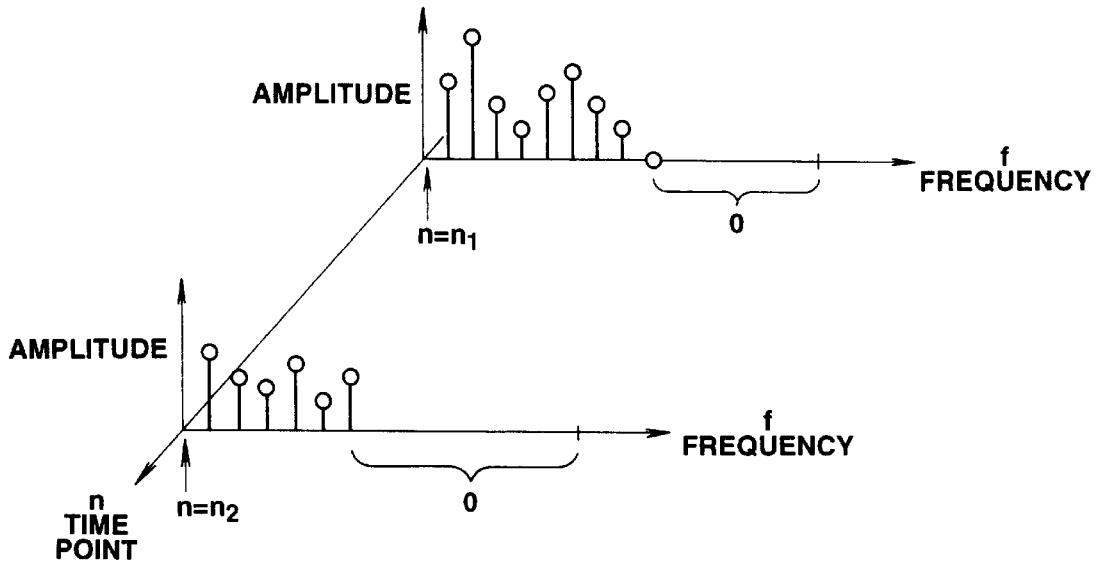
FIG. 2 illustrates the processing, as a step of an embodiment of the present invention, for shifting the harmonics at different time points towards the left and stuffing zero in the vacant portions on the frequency axes.

That is, referring to FIG. 2, the distance between neighboring harmonics in each time point is the same and set to 1. There is no valley or zero between neighboring harmonics and the amplitude data of the harmonics are stuffed beginning from the left side on the abscissa. If the number of samples for the pitch lag, that is the pitch period, at $n=n_1$, is $l_1$, $l_1/2$ harmonics are present from 0 to $\pi$, so that the spectrum represents an array having $l_1/2$ elements. If the number $l_1/2$ is not an integer, the fractional number is rounded down. In order to provide an array $a_{f1}[i]$ made up of a pre-set number of elements, e.g., $2^N$ elements, the vacated portion is stuffed with Os. On the other hand, if the pitch lag at $n=n_2$ is $l_2$, there results an array representing a spectral envelope having $l_2/2$ elements. This array is converted by zero stuffing in a similar manner to give an array $a_{f2}[i]$ having $2^N$ elements.

Consequently, an array $a_{f1}[i]$, where $0 \leqq i < 2^N$ for $n=n_1$ and an array $a_{f2}[i]$, where $0 \leqq i < 2^N$ for $n=n_2$, are produced.

As for the phase, phase values at the frequencies where the harmonics exist are stuffed in a similar manner, beginning from the left side, and the vacated portion is stuffed with zeros, to produce arrays each composed of a pre-set number 2N of elements. These arrays are $p_{p1}[i]$, where $0 \leqq i < 2^N$ for $n=n_1$ and $P_{f2}[i]$, where $0 \leqq i < 2^N$ for $n=n_2$. The phase values of the respective harmonics are those transmitted or formulated within the decoder.

If N=6, the pre-set number of elements $2^N$ is $2^N$ is $2^6=64$.

Using the arrays of the amplitude data $a_{f1}[i]$, $a_{f2}[i]$ and the arrays of the phase data $p_{f1}[i]$, $P_{f2}[i]$, inverse FFT (IFFT) at time points $n=n_1$ and $n=n_2$ is carried out.

The IFFT points are $2^{N+1}$ and, for $n=n_1$, $2^{N+1}$ complex conjugate data are produced from each $2^N$-element arrays $a_{f1}[i]$, $p_{fi}[i]$ and processed by IFFT. The results of IFFT are $2^{N+1}$ real-number data. The $2^N$ point IFFT may also be carried out by a method of diminishing the arithmetic operations of IFFT to produce a sequence of real numbers.

The IFFT-produced waveforms are denoted $a_{t1}[j]$, $a_{t2}[j]$, where $0 \leqq j < 2^{N+1}$. These waveforms $a_{t1}[j]$, $a_{t2}[j]$ represent, from the spectral data at $n=n_1$ and $n=n_2$, the waveforms for one pitch period by $2^{N+1}$ points, without regard to the original pitch period. That is, the one-pitch waveform, which should inherently be expressed by the $l_1$ or $l_2$ points, is over-sampled and represented at all times by $2^{N+1}$ points. In other words, a one-pitch waveform of a pre-set constant pitch is produced without regard to the actual or original pitch.

Figure 3:
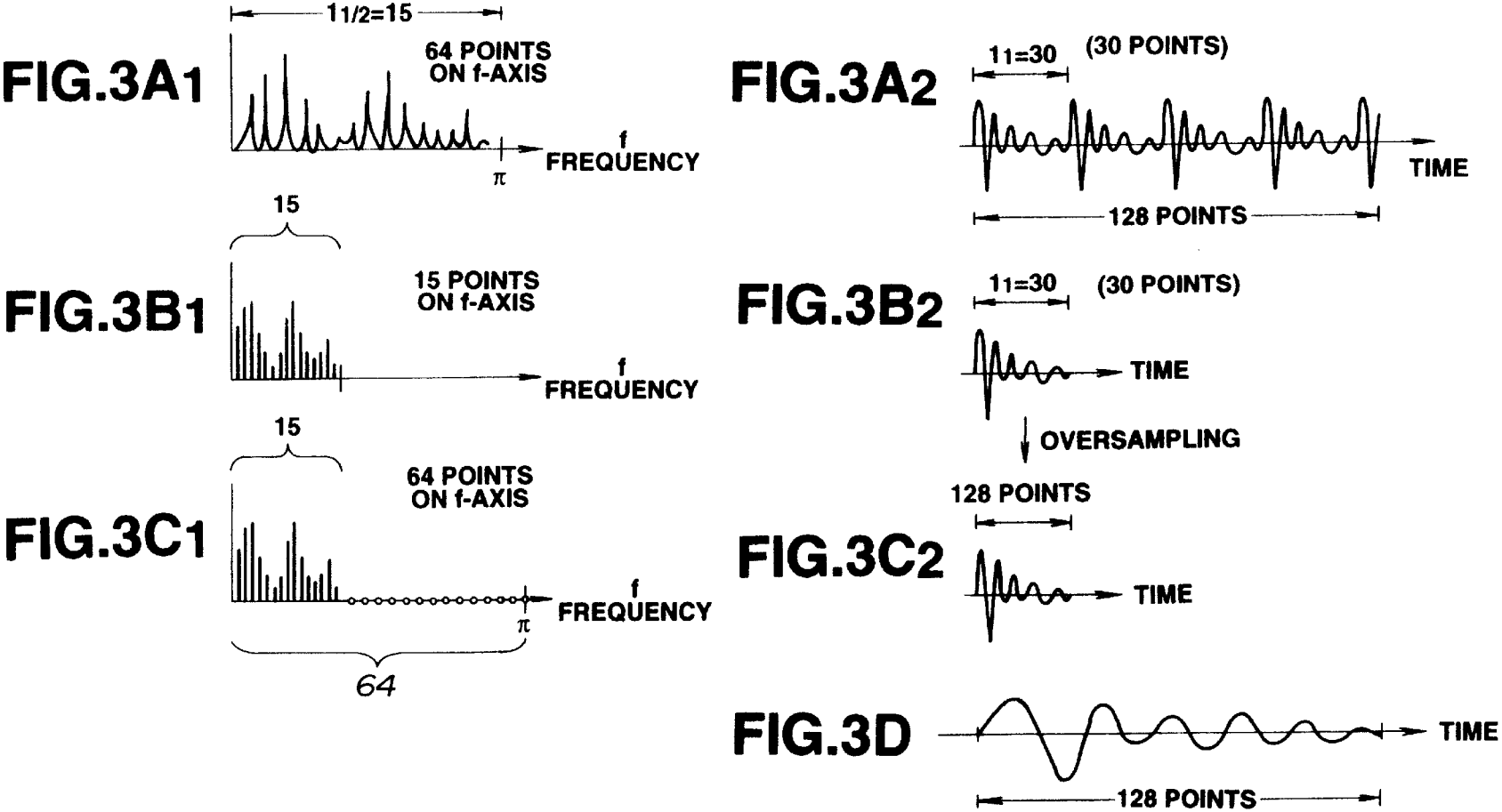
FIGS. 3$A_1$ to 3D illustrate the relation between the spectral components on the frequency axes and the signal waveforms on the time axes.

Referring to FIGS. 3$A_1$ to 3D, the following explanation is given for the case for N=6, that is, for $2^N=2^6=64$ and $2^{N+1}=^{27}=128$, with $l_1=30$, that is for $l_1/2=15$.

FIG. 3$A_1$ shows inherent spectral envelope data supplied to the decoder. There are 15 harmonics in a range of from 0 to $\pi$ on the abscissa (frequency axis). However, if the data at the valleys between the harmonics are included, there are 64 elements on the frequency axis. The IFFT processing gives a 128-point time domain waveform signal formed by repetition of waveforms with a pitch lag of 30, as shown in FIG. 3$A_2$.

In FIG. 3$B_1$, 15 harmonics are arrayed on the frequency axis by stuffing towards the left side as shown. These 15 spectral data are IFFTed to give a one pitch lag time domain waveform of 30-samples, as shown in FIG. 3$B_2$.

On the other hand, if the 15 harmonics amplitude data are arrayed by stuffing towards left as shown in FIG. 3$C_1$, and the remaining (64-15)=49 points are stuffed with zeros, to give a total of 64 elements which are then IFFTed, there results a time domain waveform signal of sample data of 128 points for one pitch period, as shown in FIG. 3$C_2$. If the waveform of FIG. 3$C_2$ is drawn with the same sample interval as that of FIGS. 3$A_2$ and 3B, a waveform shown in FIG. 3D is produced.

These data arrays $\alpha_{t1}[j]$ and $\alpha_{t2}[j]$, representing the time domain waveforms, are of the same pitch frequency, and hence allow for interpolation of the spectral envelope by overlap-and-add of the time domain waveforms.

For $|(\omega_2-\omega_1)/\omega_2| \leqq 0.1$, the spectral envelope is interpolated smoothly or continously and, if otherwise, that is, if $|(\omega_2-\omega_1)/\omega_2|>0.1$, the spectral envelope is interpolated acutely or discontinuously. As defined earlier, $\omega_1$, $\omega_2$ stand for pitch periods or frequencies for the frames at time points $n_1$, $n_2$, respectively.

The smooth or continuous interpolation for $|((\omega_2\omega_1)/\omega_2|\leqq 0.1$ is now explained.

The required length (time) of the waveform after over-sampling is first found.

If the over-sampling rates for time points $n=n_1$ and $n=n_2$ are denoted $ovsr_1$ and $ovsr_2$, respectively, equation (7) holds:

$$ovsr_1 2^{N+1}/l_1$$
$$ovsr_2=2^{N+1}/l_2 \tag{7}$$

Figure 4:
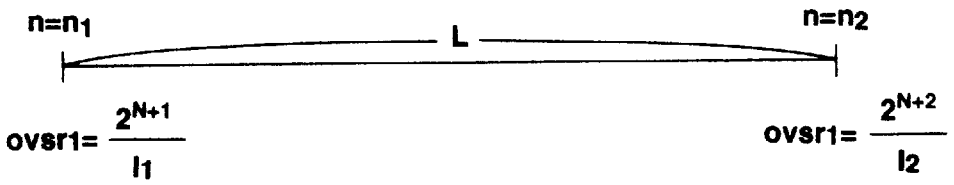
FIG. 4 illustrates the over-sampling rate at different time points.

This is represented in FIG. 4, in which L denotes the number of samples for a frame interval. By way of an example, L=160.

It is assumed that the over-sampling rate is changed linearly from time $n=n_1$ until time $n=n_2$.

If the over-sampling rate, which changes with lapse of time, is expressed as ovsr(t), as a function of time t, the waveform length Lp after over-sampling, corresponding to the pre-over-sampling length L, is given by $$\begin{aligned} L_p &= \int_0^L ovsr(t)dt = \int_0^L \left( ovsr_1 \frac{L-t}{L} + ovsr_2 \frac{t}{L} \right) dt \\ &= \int_0^L \left\{ ovsr_1 \left( 1 - \frac{t}{L} \right) + ovsr_2 \frac{t}{L} \right\} dt \\ &= \left[ ovsr_1 \left( t - \frac{t^2}{2L} \right) + ovsr_2 \frac{t^2}{2L} \right]_0^L \\ &= ovsr_1 \left( L - \frac{L}{2} \right) + ovsr_2 \frac{L}{2} \\ &= L \left( \frac{ovsr_1 + ovsr_2}{2} \right) \end{aligned} \tag{8}$$

That is, the waveform length Lp is the mean over-sampling rate $(ovsr_1+ovsr_2)/2$ multiplied by the frame length L. The length Lp is expressed as an integer by rounding down or rounding off.

Then, a waveform having a length Lp is produced from $a_{t1}[i]$ and $a_{t2}[i]$.

From $a_{t1}[i]$, the waveform having the length Lp is calculated by $$\tilde{a}_{t1}[i]=a_{t1}[\text{mod}\ ((\text{offset}'+i),\ 2^{N+1})]$$
$$\text{offset}'=2^N 0\leqq i<L_p \tag{9}$$

wherein mod(A, B) denotes a remainder resulting from division of A by B. The waveform having the length Lp is produced by repeatedly using the waveform $a_{t1}[i]$.

Similarly, from $a_{t2}[i]$, the waveform having the length Lp is calculated by $$\tilde{a}_{t2}[i]=a_{t2}[mod((offset+i),\ 2^{N+1})]$$
$$\text{offset}=2^{N+1}-\text{mod}((L_p-\text{offset}'),2^{N+1}),\ 0\leqq i<L_p \tag{10}$$

Figure 5:
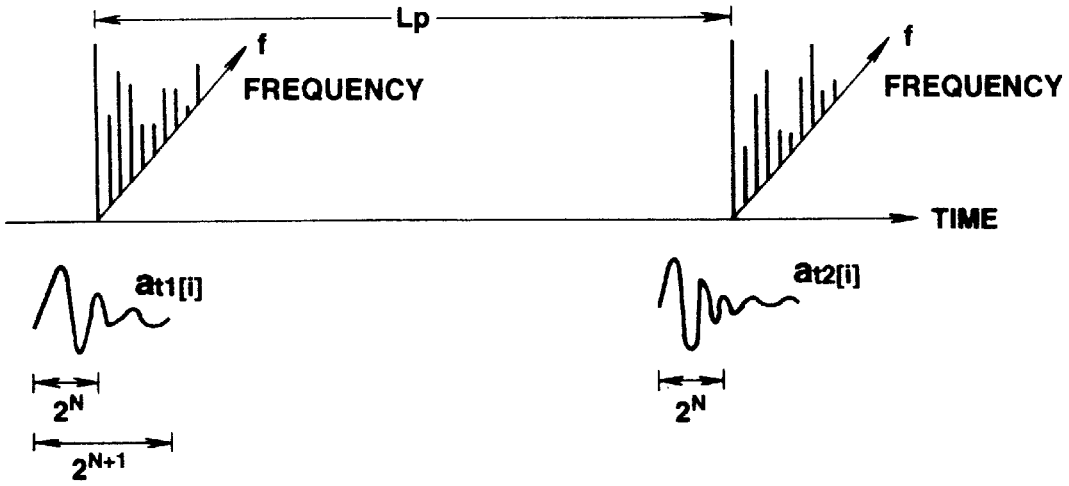
FIG. 5 illustrates a time-domain signal waveform derived from inverse orthogonal transformation of spectral components at different time points.

FIG. 5 illustrates the operation of interpolation. Since phase adjustment is made so that the center points of the waveforms $a_{t1}[i]$ and $a_{t2}[i]$ each having the length $2^{N+1}$ are located at $n=n_1$ and $n=n_2$, it is necessary to set an offset value offset' to $2^N$. If this offset value offset' is set to 0, the leading ends of the waveforms $a_{t1}[i]$ and $a_{t2}[i]$ will be located at $n=n_1$ and $n=n_2$.

Figure 6:
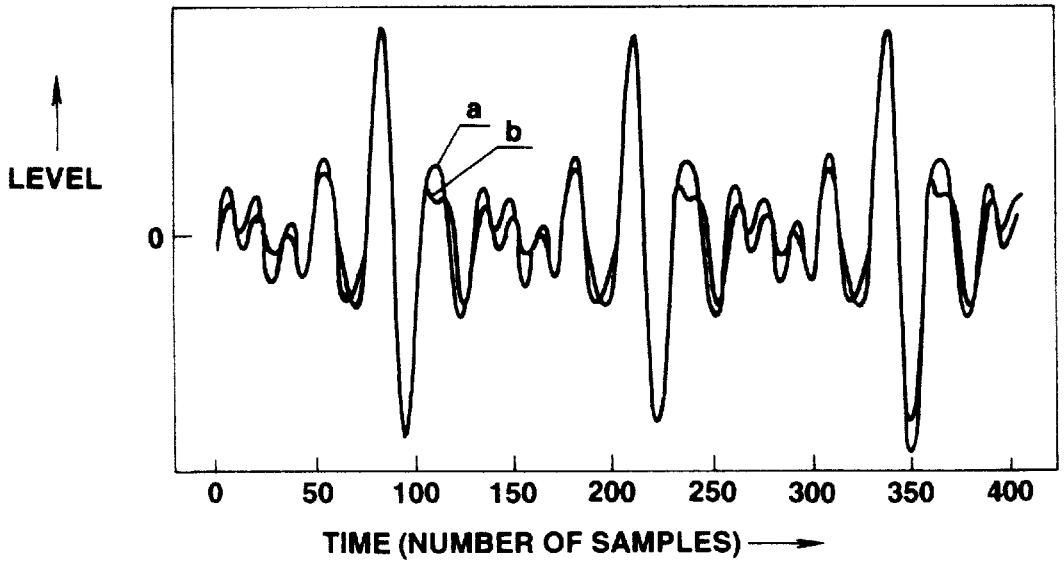
FIG. 6 illustrates a waveform of a length Lp formulated based upon the time-domain signal waveform derived from inverse orthogonal transformation of spectral components at different time points.
Figure 7:
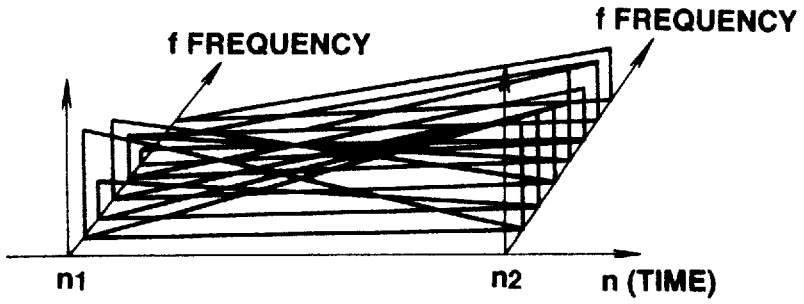
FIG. 7 illustrates the operation of interpolating the harmonics of the spectral envelope at time point $n_1$ and the harmonics of the spectral envelope at time point $n_2$.

In FIG. 6, a waveform a and a waveform b are shown as illustrative examples of the above-mentioned equations (9) and (10), respectively.

The waveforms of equations (9) and (10) are interpolated. For example, the waveform of equation (9) is multiplied by a windowing function which is 1 at time $n=n_1$ and which linearly decays with lapse of time until it becomes zero at $n=n_2$. On the other hand, the waveform of equation (10) is multiplied by a windowing function which is 0 at time $n=n_1$ and which linearly increases with lapse of time until it becomes 1 at $n=n_2$. The windowed waveforms are added together, and the result of such interpolation $a_{ip}[i]$ is given by $$a_{ip}[i] = \tilde{a}_{t1}[i]\frac{L_p - i}{L_p} + \tilde{a}_{t2}[i]\frac{i}{L_p}\ ,0 \leqq i < L_p \tag{11}$$

The pitch-synchronized interpolation of the spectral envelopes achieved in the above manner is equivalent to interpolating the respective harmonics of the spectral envelopes at time $n=n_1$ and the respective harmonics of the spectral envelopes at time $n=n_2$.

The waveform is reverted to the original sampling rate and to the original pitch period or frequency through simultaneous pitch interpolation.

The over-sampling rate is set to $$ovsr(i) = ovsr_1\frac{L-i}{L} + ovsr_2\frac{i}{I}\ ,0 \leqq i < L$$

The term idx(n), $0\leqq n<L$, denotes with which index distance the over-sampled waveform $a_{ip}[i]$, $0\leqq i<Lp$ should be re-sampled for reversion to the original sampling rate. That is, mapping from $0\leqq n<L$ to $0\leqq i<Lp$ is carried out. The term idx(n) is defined by $$idx(n) = 0, n = 0 \tag{12}$$
$$idx(n) = \sum_{i=1}^{n} ovsr(i), 1 \leqq n < L$$

In place of the definition in equation (12), idx(n) may also be defined by $$idx(n) = \sum_{i=1}^{n} ovsr(i-0.5) \tag{13}$$

or $$idx(n) = \int_0^n \left( ovsr_1\frac{L-t}{L} + ovsr_2\frac{t}{L} \right) dt \tag{14}$$

Although the definition in equation (14) is most strict, the above-given equation (12) is usually sufficient in practice.

Thus, if idx(n) is an integer, the desired output waveform $a_{out}(n)$ may be found by $$a_{out}[n]=a_{ip}[idx(n)], o\leqq n<L \tag{15}$$

However, idx(n) is usually not an integer. The method for calculating $a_{out}[n]$ by linear interpolation is now explained. It should be noted that a higher order interpolation may also be employed.

$$\begin{aligned} a_{out}[n] &= a_{ip}[\lceil idx(n)\rceil] \times \{idx(n) - \lfloor i(dx)\rfloor\} \times \\ &\quad a_{ip}[\lfloor idx(n)\rfloor] \times \{\lceil idx(n)\rceil - idx(n)\} \\ 0 &\leqq n < L \text{ for } (\lceil idx(n)\rceil \neq \lfloor idx(n)\rfloor) \end{aligned} \tag{16}$$

where [x] is a maximum integer not exceeding x and [x] is the minimum integer not lower than x.

Figure 8:
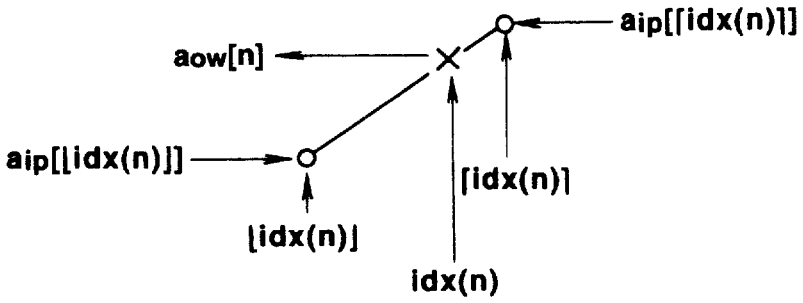
FIG. 8 illustrates the operation of interpolation for resampling for restoration to the original sampling rate.

This method affects weighting depending on the ratio of an internal division of a line segment, as shown in FIG. 8.

If idx(n) is an integer, the above-mentioned equation (15) may be employed.

The above procedure gives $a_{out}[n]$, which is the desired waveform for ($0 \leqq n < L$).

The above is the explanation of smooth or continuous interpolation of the spectral envelope for $|(\omega_2-\omega_1)/\omega_2|0.1$. If otherwise, that is, $|(\omega_2-\omega_1)/\omega_2|>0.1$, the spectral envelope is interpolated acutely or discontinuously.

The spectral envelope interpolation for $|(\omega_2-\omega_1)/\omega_2|>0.1$ is now explained.

In this case, only the spectral envelope is interpolated, without interpolating the pitch period.

The over-sampling rates $ovsr_1$, $ovsr_2$ $$ovsr_1=2^{N+1}/l_1$$

$$ovsr_2=2^{N+1}/l_2 \tag{17}$$

are defined in association with respective pitches, as in the above equation (7).

The lengths of the waveforms after over-sampling, associated with these rates, are denoted $L_1$, $L_2$. Then, $$L_1=L\ ovsr_2;\ L_2=L\ ovsr_2 \tag{18}$$

Since the pitch period is not interpolated, and hence the over-sampling rates $ovsr_1$, $ovsr_2$ are not changed, the integration as shown by equation (14) is not carried out, but multiplication suffices. In this case, the result is turned into an integer by rounding up or rounding off.

Then, from the waveforms $a_{t1}$, $a_{t2}$, the waveforms of lengths $L_1$, $L_2$ are produced, as in above-mentioned equation (9).

$$\tilde{a}_{t1}[i]=a_{t1}[\mathrm{mod}\ ((\mathrm{offset}'+i),\ 2^{N+1})]$$

$$\mathrm{offset}'=2^N\ 0 \leqq i < L_1 \tag{19}$$

$$\tilde{a}_{t2}[i]=a_{t2}[\mathrm{mod}((\mathrm{offset}+i),2^{N+1})]$$

$$\mathrm{offset}=2^{N+1}-\mathrm{mod}((L_2-\mathrm{offset}'),2^{N+1}),\ 0 \leqq i < L_2 \tag{20}$$

The equations (19), (20) are re-sampled at different sampling rates. Although windowing and re-sampling may be carried out in this order, re-sampling is carried out first for reversion to the original sampling frequency fs, after which windowing and overlap-adding (OLA) are carried out.

For the waveforms of the equations (19), (20), the indices $idx_1(n)$ , $idx_2(n)$ for re-sampling the waveforms are respectively found by $$idx_1(n)=n\ ovsr_1,\ 0 \leqq idx_1(n) < L_1 \tag{21}$$

$$idx_2(n)=n\ ovsr_2,\ 0 \leqq idx_2(n) < L_2 \tag{22}$$

Then, from equation (21), the following equation $$\begin{aligned} a_1[n]&=\tilde{a}_{t1}[\lceil idx_1(n)\rceil]\times\{idx_1(n)-\lfloor idx_1(n)\rfloor\} \\ &+\tilde{a}_{t1}[\lfloor idx_1(n)\rfloor]\times\{\lceil idx_1(n)\rceil-idx_1(n)\} \\ &(\text{when } \lceil idx_1(n)\rceil\neq\lfloor idx_1(n)\rfloor) \\ a_1[n]&=\tilde{a}_{t1}[idx_1(n)](\text{when } \lceil idx_1(n)\rceil=\lfloor idx_1(n)\rfloor \\ &0 \leqq n < L \end{aligned} \tag{23}$$

is found, whereas, from equation (22), the following equation $$\begin{aligned} a_2[n]&=\tilde{a}_{t2}[\lceil idx_2(n)\rceil]\times\{idx_2(n)-\lfloor idx_2(n)\rfloor\} \\ &+\tilde{a}_{t2}[\lfloor idx_2(n)\rfloor]\times\{\lceil idx_2(n)\rceil-idx_2(n)\} \\ &(\text{when } \lceil idx_2(n)\rceil\neq\lfloor idx_2(n)\rfloor) \\ a_2[n]&=\tilde{a}_{t2}[idx_2(n)](\text{when } \lceil \mathrm{idx}_2(n)\rceil=\lfloor idx_2(n)\rfloor) \\ &0 \leqq n < L \end{aligned} \tag{24}$$

is found.

The waveforms $a_1[n]$ and $a_2[n]$, where $0 \leqq n < L$, are waveforms reverted to the original waveform, with their lengths being L. These two waveforms are subsequently windowed and added.

Figure 9:
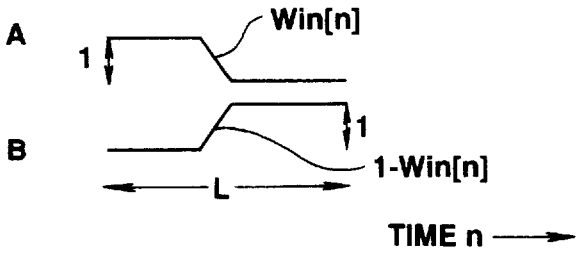
FIG. 9 illustrates an example of a windowing function for summing waveforms obtained at different time points.

For example, the waveform $a_1[n]$ is multiplied with a window function $W_{in}[n]$ as shown in FIG. 9A, while the waveform $a_2[n]$ is multiplied with a window function $1-W_{in}[n]$ as shown in FIG. 9B. The two windowed waveforms are then added together. That is, if the ultimate output is $a_{out}[n]$, it is found by the equation $$a_{out}[n]=a_1[n]W_{in}[n]+a_2[n](i-W_{in}[n])$$

For L=160, examples of the window function $W_{in}[n]$ include $$W_{in}[n]=1,\ 0 \leqq n < 50,$$

$$W_{in}[n]=(110-n)/60,\ 5 \leqq n < 110,\ \text{and}$$

$$W_{in}[n]=0,\ 110 \leqq n < 160.$$

The above explains the method for synthesis with pitch period interpolation and of that without pitch period interpolation. Such synthesis may be employed for synthesis of voiced portions on the decoder side with multi-band excitation (MBE) coding. It may be directly employed for a sole voiced (V)/unvoiced (UV) transient or for synthesis of the voiced (V) portion in case V and UV co-exist. In such a case, the magnitude of the harmonics of the unvoiced sound (UV) may be set to zero.

Figure 10:
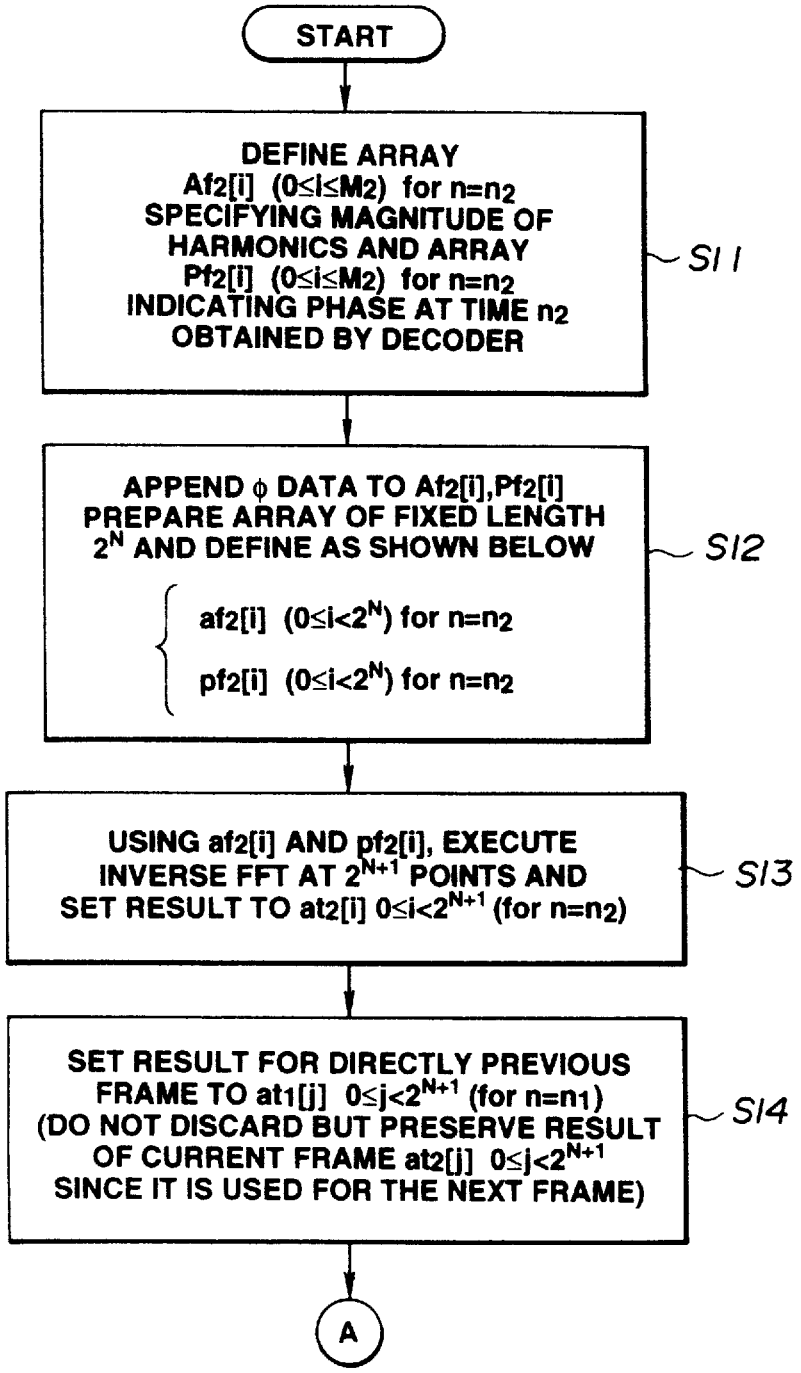
FIG. 10 is a flow chart for illustrating the operation of the former half portion of the decoding method for speech signals embodying the present invention.
Figure 11:
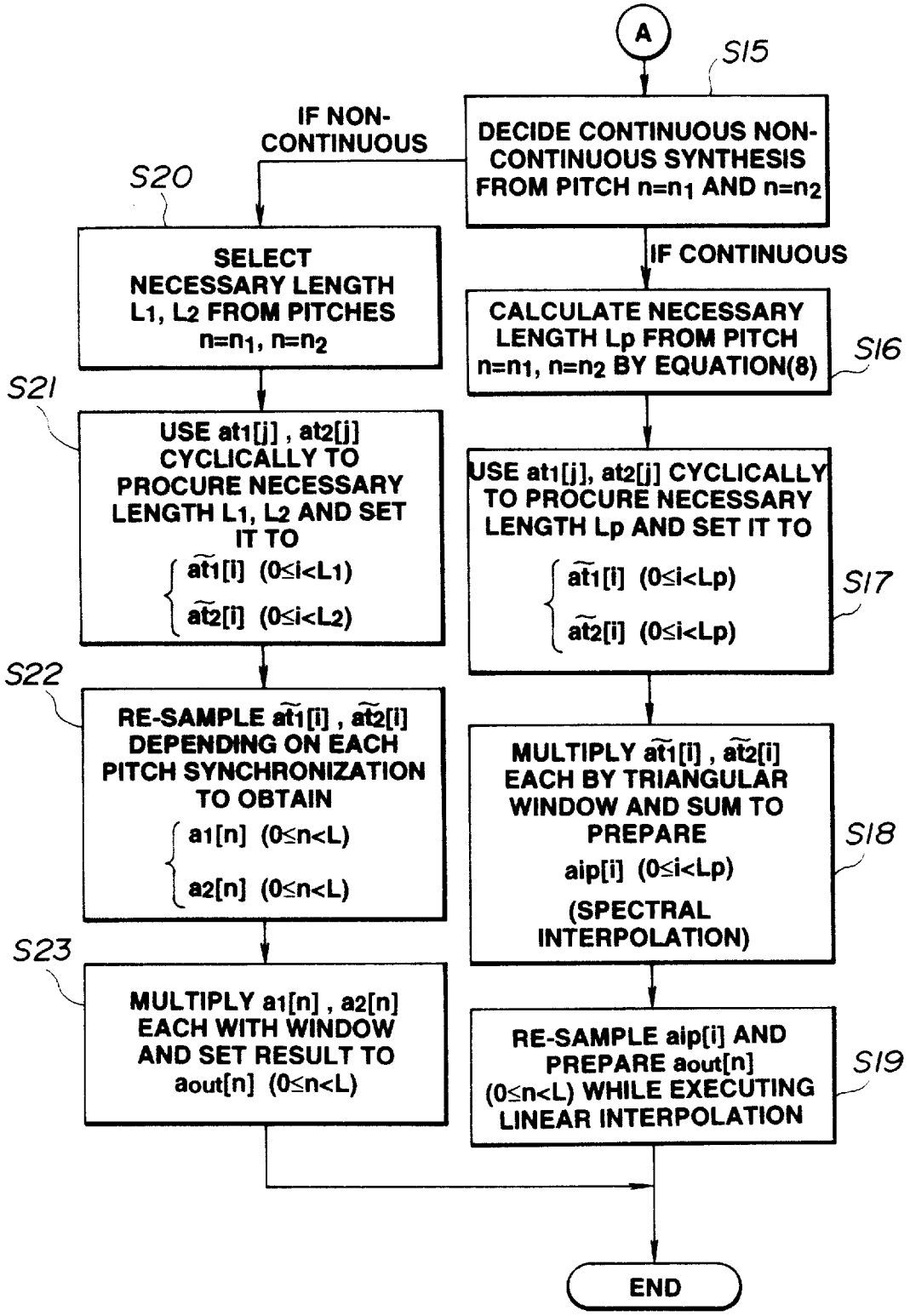
FIG. 11 is a flow chart for illustrating the operation of the latter half portion of the decoding method for speech signals embodying the present invention.

The operations during synthesis are summarized in the flow charts of FIGS. 10 and 11. The flow charts illustrate the state in which the processing at $n=n_1$ comes to a close and attention is directed to the processing at $n=n_2$.

At the first step S11 of FIG. 10, an array $A_{f2}[i]$ specifying the amplitude of the harmonics and an array $P_{f2}[i]$ specifying the phase at time $n=n_2$ obtained by the decoder are defined. $M_2$ specifies the maximum order number the harmonics at time $n_2$.

At the next step S12, these arrays $A_{f2}[i]$ and $P_{f2}[i]$ are stuffed towards the left, and 0s are stuffed in the vacated portions in order to prepare arrays each having a fixed length $2^N$. These arrays are defined as $a_{f2}[i]$ and $f_{f2}[i]$.

At the next step S13, the arrays $a_{f2}[i]$ and $f_{f2}[i]$ of the fixed length $2^N$ are inverse FFTed at $2^{N+1}$ points. The result is set to $a_{t2}[j]$.

At step S14, the result $a_{t1}[j]$ of the directly previous frame is taken and, at the next step S15, the decision as to continuous/non-continuous synthesis is given based upon the pitch periods at time points $n=n_1$ and $n=n_2$. If decision is given for continuous synthesis, the program transfers to step S16. Conversely, if a decision is given for non-continuous synthesis, the program transfers to step S20.

At step S16, the required length Lp of the waveform is calculated from the pitch periods at time points $n=n_1$ and $n=n_2$, in accordance with equation (8). The program then transfers to step S17 where the waveforms $a_{t1}[j]$ and $a_{t2}[j]$ are repeatedly employed in order to procure the necessary length waveform Lp. This corresponds to the calculations of equations (9) and (10). The waveforms of the length Lp are multiplied with a linearly decaying triangular window function and a linearly increasing triangular function and the resulting windowed waveforms are added together to produce a spectral interpolated waveform $a_{ip}[n]$, as indicated by the equation (11).

At the next step S19, the waveform $a_{ip}[i]$ is re-sampled and linearly interpolated in order to produce the ultimate output waveform $a_{out}[n]$ in accordance with the equation (16).

If the decision is given for non-continuous synthesis at step S15, the program transfers to step S20 in order to select the required lengths $L_1$, $L_2$ of the waveforms from the pitch periods at the time points $n=n_1$ and $n=n_2$. The program then transfers to the next step S21 where the waveforms $a_{t1}[j]$ and $a_{t2}[j]$ are repeatedly employed in order to procure the necessary waveform lengths $L_1$, $L_2$. This corresponds to calculations of the equations (19), (20).

With the above-described decoding method for encoded speech signals of the illustrated embodiment, the volume of the sum-of-product processing operations by inverse FFT for N=6, $2^N=64$ and $2^{N+1}=128$, is approximately 64×7×7. This can be found by setting x=128 since the volume of the sum-of-product processing operations for x-point complex data by IFFT is approximately (x/2) logx×7. On the other hand, the volume of the sum-of-product processing operations required for calculating equations (11), (12), (16), (19), (20), (23) and (24) is 160×12. The sum of these volumes of the processing operations, required for decoding, is on the order of 5056.

This accounts for about less than one-tenth of the volume of the sum-of-product processing operations required for the above-described conventional decoding method, which is on the order of approximately 51200, thus enabling the processing volume for the decoding operation to be reduced significantly.

That is, with conventional sine wave synthesis, the amplitude and the phase or the frequency of each of the harmonics is interpolated, and the time domain waveforms for each of the harmonics, the frequency and the amplitude of which change with lapse of time, are calculated on the basis of the interpolated parameters. A number of such time domain waveforms equal to the number of harmonics are summed together to produce a synthesized waveform. Thus the volume of the sum-of-product processing operations is on the order of tens of thousand steps per frame. With the method of the illustrated embodiment, the volume of the processing operations may be reduced to several thousand steps. The practical merit accrued from the reduction in the volume of processing operations is outstanding because synthesis represents the most critical portion in the waveform analysis synthesis system employing the multi-band excitation (MBE) techniques. Specifically, if the decoding method of the present invention is applied to e.g., MBE, the processing capability as a whole requires slightly less than a score of MIPS in a conventional system, while it can be reduced to several MIPS with the illustrated embodiment.

The present invention is not limited to the above-described illustrative embodiments. For example, the decoding method according to the present invention is not limited to a decoder for a speech analysis/synthesis method employing multi-band excitation, but may be applied to a variety of other speech analysis/synthesis methods in which sine wave synthesis is employed for a voiced speech portion or in which the unvoiced speech portion is synthesized based upon noise signals. The present invention finds application not only in signal transmission or signal recording/reproduction but also in pitch conversion, speed conversion, regular speech synthesis or noise suppression.

What is claimed is:

1. A method for decoding encoded speech signals in which the encoded speech signals are decoded by sine wave synthesis based upon information of respective harmonics of a plurality of frames corresponding to the speech signals, wherein the harmonics of a frame are spaced apart from one another by a pitch period and have respective time domain waveforms with respective amplitudes and phases, the pitch period varies from frame to frame, and wherein the harmonics are obtained by transforming the speech signals from the time domain into corresponding information in a frequency domain for each of the plurality of frames, the method comprising the steps of:

appending zero data to an end of an amplitude data array representing the respective amplitudes of the harmonics to produce a first array having a pre-set number of amplitude elements;

appending zero data to an end of a phase data array representing the respective phases of the harmonics to produce a second array having a pre-set number of phase elements;

performing inverse orthogonal transformation on the first and second arrays to produce time-domain information used to generate a time domain waveform for each of the plurality of frames;

producing time domain waveforms having a predetermined length by repeating the respective time domain waveforms for each of the plurality of frames; and interpolating pitch periods and spectral components of the time domain waveforms having the predetermined length for two neighboring frames separated by a predetermined interval using one of a first process in which the time domain waveforms having the predetermined length for the two neighboring frames are windowed and overlap-added and a second process in which the time domain waveforms having the predetermined length for the two neighboring frames are resampled at a rate that varies with a change in the pitch period of the harmonics of the two neighboring frames.

2. The method for decoding encoded speech signals as claimed in claim 1, wherein the two neighboring frames corresponding to the time domain waveforms produced by inverse orthogonal transformation of the first array into the time domain information each have a pitch period, each of the time domain waveforms of the two neighboring frames are repeated to produce the respective time domain waveforms having the predetermined length, the time domain waveforms having the predetermined length of the two neighboring frames are processed by a pre-set windowing process, and the windowed time domain waveforms having the predetermined length of the two neighboring frames are overlap-added to produce a waveform having a spectral envelope that is interpolated depending upon the change in the pitch period of the harmonics to output a time domain waveform signal of a pre-set sampling rate.

3. The method for decoding encoded speech signals as claimed in claim 2, wherein if a change in pitch period between the two neighboring frames is small, the spectral envelope is interpolated smoothly or continuously, and if the change in pitch period between the two neighboring frames is not small, the spectral envelope is interpolated acutely or discontinuously.

4. The method for decoding encoded speech signals as claimed in claim 3, wherein if the change in pitch period between the two neighboring frames is small, both the pitch period and the spectral envelope are interpolated, and if the change in pitch period between the two neighboring frames is not small, only the spectral envelope is interpolated.

5. The method for decoding encoded speech signals as claimed in claim 3, wherein the two neighboring frames occur at time points $n_1$, $n_2$ and have respective pitch periods $\omega_1$, $\omega_2$, and the spectral envelope is interpolated smoothly or continuously if $|(\omega_2-\omega_1)/\omega_2|\leqq 0.1$ and acutely or discontinuously if $|(\omega_2-\omega_1)/\omega_2|>0.1$.

6. The method for decoding encoded speech signals as claimed in claim 1, further including the steps of:

resampling the time domain waveforms having the predetermined length depending upon the respective pitch periods of the two neighboring frames;

windowing the resampled time domain waveforms having the predetermined length in a pre-set manner; and overlap-adding the windowed time domain waveforms having the predetermined length to produce an output waveform.

7. The method for decoding encoded speech signals as claimed in claim 1, wherein the sine wave synthesis used in encoding and decoding speech signals is based on multi-band excitation.

8. The method of decoding encoded speech signals as claimed in claim 1, wherein in the step of interpolating includes:

windowing the time domain waveforms having the predetermined length of the two neighboring frames, overlap-adding the windowed time domain waveforms, and resampling the overlap-added time domain waveform at rate that varies with the change in pitch period of the harmonics of the two neighboring frames.

9. The method of decoding encoded speech signals as claimed in claim 1, wherein the step of interpolating includes:

resampling the time domain waveforms having the predetermined length of the two neighboring frames at a rate that varies with the change in pitch period of the harmonics of the two neighboring frames, and windowing and overlap-adding the resampled time domain waveforms.

* * * * *